US007069870B2

(12) United States Patent
Orii et al.

(10) Patent No.: US 7,069,870 B2
(45) Date of Patent: Jul. 4, 2006

(54) ELECTRIC SEWING MACHINE

(75) Inventors: Akira Orii, Tokyo (JP); Satoru Ishikawa, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 11/148,458

(22) Filed: Jun. 9, 2005

(65) Prior Publication Data

US 2006/0005751 A1 Jan. 12, 2006

(30) Foreign Application Priority Data

Jul. 6, 2004 (JP) ..... 2004-198786
Jul. 16, 2004 (JP) ..... 2004-210069

(51) Int. Cl.
*D05B 19/12* (2006.01)

(52) U.S. Cl. ..... 112/275; 112/470.01

(58) Field of Classification Search ..... 112/470.01, 112/277, 275, 102.5, 470.06, 445; 700/136
See application file for complete search history.

(56) References Cited

U.S. PATENT DOCUMENTS 5,247,449 A * 9/1993 Yoshida ..... 700/136

* cited by examiner

*Primary Examiner*—Danny Worrell
(74) *Attorney, Agent, or Firm*—Nields & Lemack

(57) ABSTRACT

Disclosed is the invention in connection with an electric sewing machine comprising a machine body 1 and a controller 2, wherein the controller 2 is responsive to a first press to produce a signal for starting the machine body 1 and is responsive to further press to produce a signal for driving the machine body 1 at a stitching speed (drive speed) in accordance with the pressing amount. The machine body 1 is provided with a control device 11 which is connected to a changing device 30 which is operated to change the control content of the control device 11. The changing device 30 may be operated to switch the control device 11 between being operative and being inoperative. In case the control device 11 is switched to being inoperative, the control device 11 neglects the instruction signal from the controller 2, for example, produces a stop signal to a motor drive device 12 in response to a machine drive signal from the controller 2, thereby to maintain the machine motor as stopped. Therefore, if the changing device 30 is selectively operated beforehand to switch the controller 11 to being inoperative, the machine body 1 will not driven in response to the instruction signal from the controller 11 which may be wrong operated. Thus the safety may be secured.

18 Claims, 6 Drawing Sheets

ELECTRIC SEWING MACHINE

BACKGROUND OF THE INVENTION

The present invention relates to an electric sewing machine.

It is generally known that the electric sewing machine may be started, stopped and controlled as to the drive speed (stitching speed) by operation of a lever or a foot controller which is connected to the machine body. Further it is generally known that the foot controller may be cordless to control the sewing machine by wireless as disclosed, for example, in the Japanese patent No. 2722769.

However in case the wireless controller is used, troubles may be caused due to outer noises or wrong operation of the wireless controller by a machine operator.

For example, the sewing machine may be caused to start in case the wireless controller is carelessly treaded on by foot while the machine operator is threading the machine needle or setting a cloth under the machine needle. Further, the wireless controller, which is physically independent from the machine body, may produce a start signal in case something is placed on the wireless controller at a place spaced from the machine body.

Further, the wireless controller may be influenced by the signals of other appliances. Generally in the house, there are various electric waves of different frequencies and the infrared rays as produced from the remote control of television, video and so on. The wireless controller may be wrong operated by such signals. Such wrong operation may be prevented by an ID which may be designated to the wireless controller such that the ID may be acknowledged only by a definite signal to make effective the wireless controller. It is, however, actually something troublesome to initialize the ID, the initialization being required each time the wireless controller is exchanged. Further it is troublesome to change or charge the battery as a power source of the wireless controller.

It is, therefore, the object of the invention to solve the various problems which may be caused in case the wireless controller is used in connection with the sewing machine.

SUMMARY OF THE INVENTION

For the purpose of attaining the object, the electric sewing machine of the invention is provided with a wireless controller electrically connected to the sewing machine by wireless, a receiver device provided on the side of the sewing machine to receive the instruction signals produced from the wireless controller, a control device for controlling the operation of the sewing machine in response to the instruction signals from the wireless controller, a device for changing the control content of the control device.

The control content changing device may include a device for switching the control device between an effective condition and an ineffective condition. With the switching device being provided on the side of the sewing machine, the machine operator may easily make access to the switching device to make ineffective the instruction from the wireless controller, thereby to make the sewing machine free of the outer noises and further to make the sewing machine free of the wrong operation which may be caused by wrong operation of the wireless controller.

Further in case the wireless controller is formed to produce signals for starting and stopping the sewing machine and for instructing a drive speed of the sewing machine, the control content changing device may be formed to change the control content of the control device to start the sewing machine at a slow speed in response to the start instruction signal from the wireless controller.

Thus the slow start may be selected beforehand at the control content changing device such that the sewing machine may be started at a low speed in response to the start signal from the wireless controller in case the wireless controller is wrong operated and such that the machine operator may cope with the slow start of the sewing machine in the unexpected occasion. The slow start mode may be maintained for the normal use of the sewing machine for stitching operation.

Further the control content changing device may be set to change the control content of the drive speed instruction to limit a maximum drive speed of the sewing machine. Further the control content changing device may be operated to change the rate between the drive speed instruction and the actual drive speed of the sewing machine. With such change of the control content of speed, a safety may be secured in stitching operation. Further the wireless controller may be so formed as to reduce the speed change of the sewing machine for a predetermined pressing amount range of the wireless controller at the time of starting the sewing machine. For example, the wireless controller may be formed to be not so sensitive or to make no speed change in a first pressing amount range, that is, in an insensitive range.

At least one or more of the control features as mentioned above may be incorporated in the sewing machine. The change of control content may be typically made by operation of the control content changing device by the machine operator, or may be made by control signals which may be given otherwise.

Further the condition of the wireless controller may be indicated on the side of the sewing machine.

According to the electric sewing machine of the invention as mentioned above, the risk of wrong operation of the sewing machine due to the wrong operation of the wireless controller and/or due to the outer noises may be avoided.

According to the invention, the wireless controller may be provided with an identification signal which is produced and compared with a discrimination signal registered beforehand on the side of the sewing machine so that the control signal from the wireless controller may be neglected in case the signal other than the identification signal of the wireless controller is produced. The registration of the discrimination signal may be easily made by means of an input device for connecting the wireless controller and the sewing machine. Further a charging device may be provided on the side of the sewing machine so that the charge of the wireless controller and the registration of the discrimination signal may be simultaneously made. This may be realized, for example, by a common connecting terminal given to the input device and to the charging device. It is preferable that the connecting terminal is provided on the bed of sewing machine.

With the constituent elements of the invention as mentioned above, the wireless controller discriminating signal may be easily registered, and the wrong operation of the sewing machine may be prevented by confirmation of the identification signal of the wireless controller. Further a second connecting terminal may be provided on the side of the wireless controller so that the second connecting terminal may be in contact with the connecting terminal provided on the machine bed when the wireless controller is placed on the machine bed. Thus the registration of the discriminating signal and the charge of the wireless controller may be simultaneously made.

DETAILED DESCRIPTION OF THE PREFERRED EMBODIMENTS

The invention will be described in reference to the attached drawings.

Figure 1:
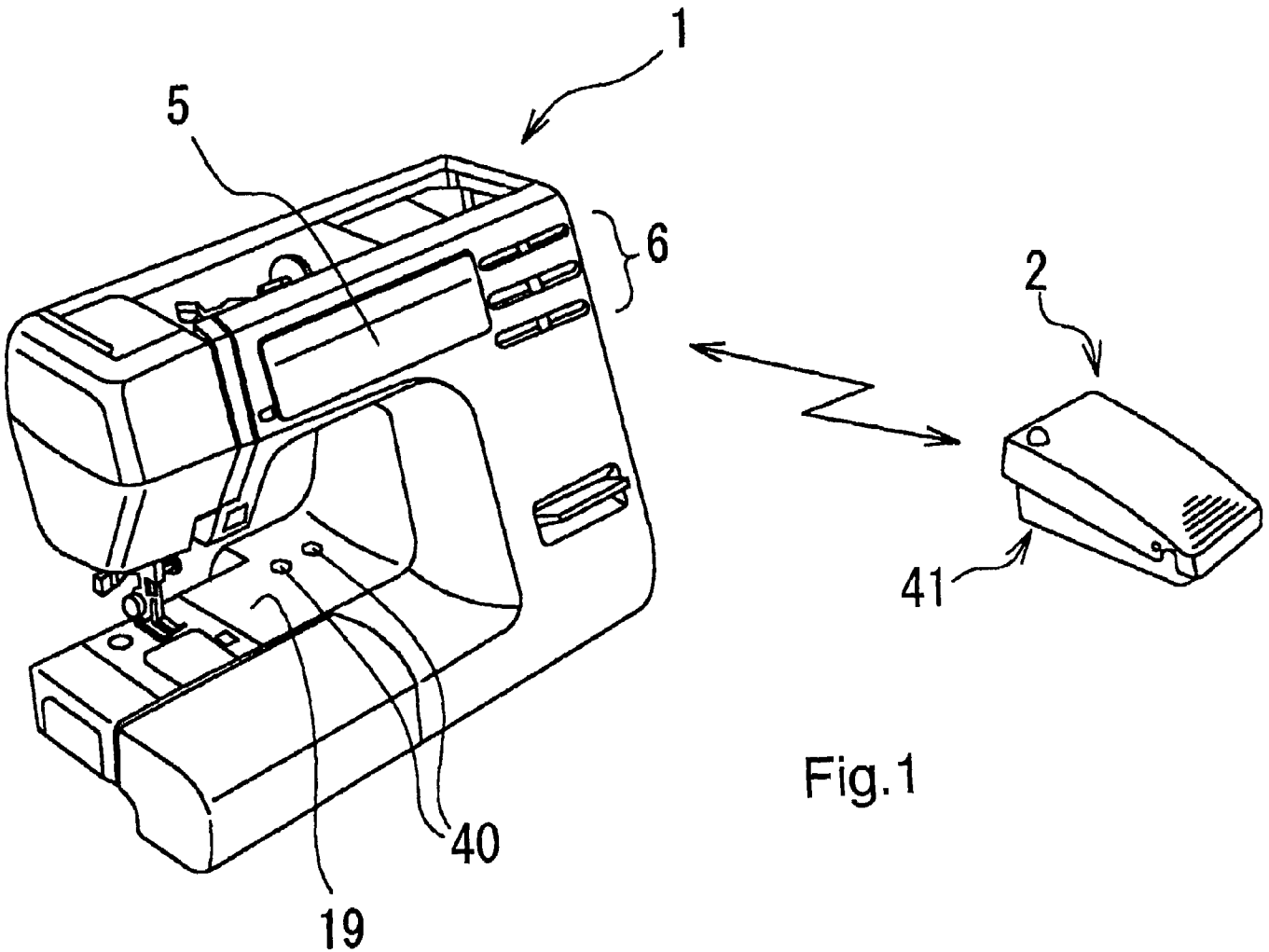
FIG. 1 is a perspective view of a sewing machine having the invention incorporated therein and shown with a wireless controller placed as spaced from the sewing machine.

As shown in FIG. 1, the electric sewing machine of the invention is composed of a machine body 1 and a controller 2. The machine body 1 and the controller 2 are not electrically connected by a cable but connected by wireless.

The machine body 1 is provided with an indicating device 5 for giving various indications thereat including the instruction contents as transmitted from the controller 2.

The machine body 1 is provided with an operating device 6 which is accessed and operated by a machine operator.

Figure 5:
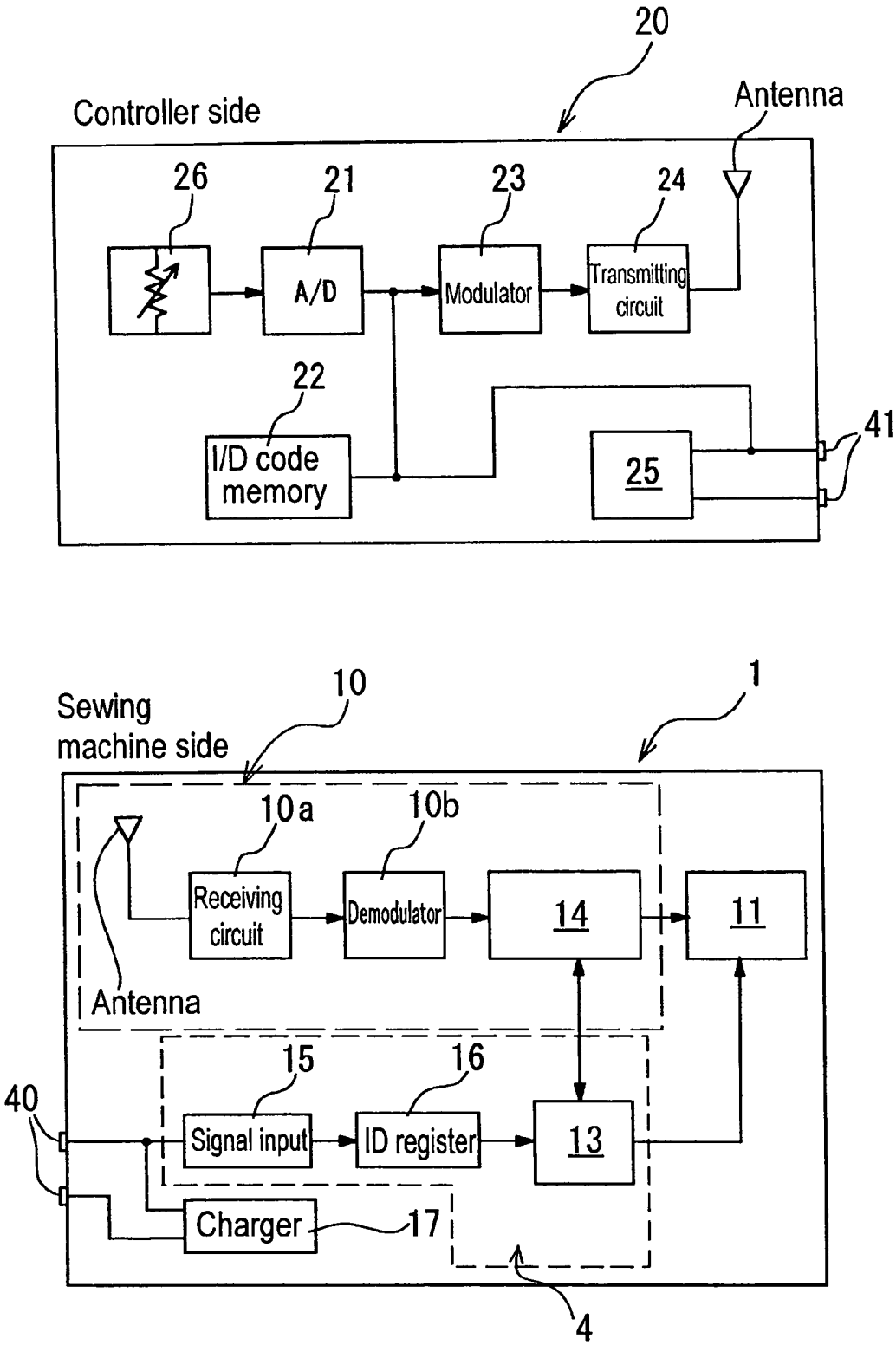
FIG. 5 shows block diagrams showing the essential parts of the invention for the sewing machine and the wireless controller respectively.

The controller 2 is operated as pressed by foot against a spring force. With a first pressure given, the controller 2 gives a signal for starting the machine body 2. With a further pressure given, the variable resistor 26 is operated to give the machine body 1 a speed control signal in response to the pressing amount as shown in FIG. 5. In response to the speed control signal from the controller 2, the machine body 2 is operated to perform a stitching operation with a predetermined stitching speed (drive speed).

Figure 3:
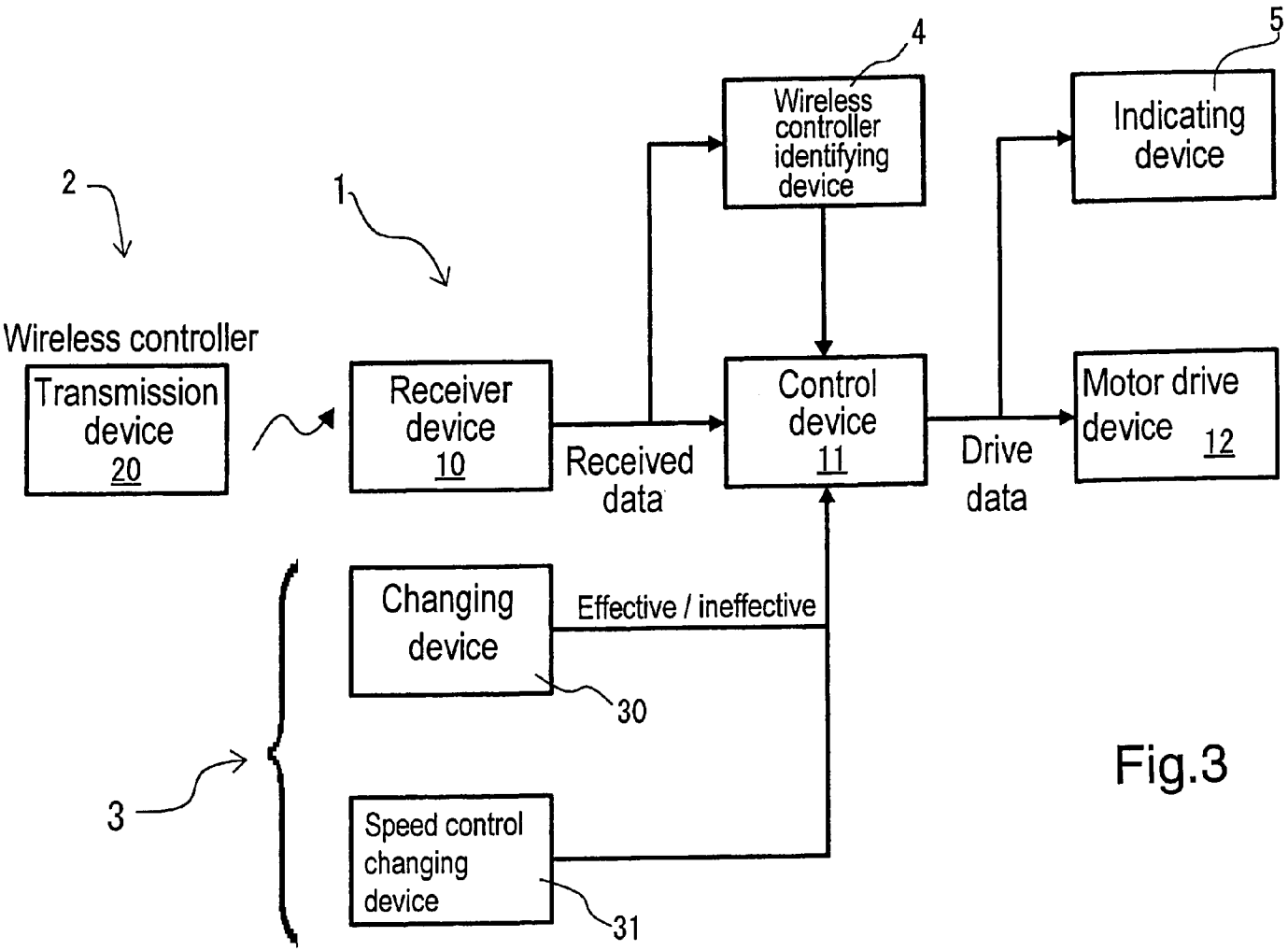
FIG. 3 is a block diagram showing the essential parts of the invention.

As shown in FIG. 3, the controller 2 is provided with a transmission device 20 for transmitting to the machine body 1 the instruction signals produced in accordance with the pressing amount of controller.

The machine body 1 is provided with a receiver device 10 for receiving the instruction signals from the transmission device 20. In response to the instruction signals, a control device 11 is operated to control a motor drive device 12, thereby to enable the machine body 1 to perform stitching operation.

According to the embodiment, the machine body 1 is provided with an identifying device 4 for detecting the signal level corresponding to the pressing level of the controller 2. In response to the signal level information from the identifying device 4, the control device 11 is operated to make indications at the indicating device 5. Further the power information including the information of remaining amount of power of the battery is transmitted to the control device 11 from the transmission device 20 so as to be indicated at the indicating device 5. Further the control device 11 makes indication including the warning to change the battery at the indicating device 5 on the basis of the signal level, the remaining amount of power of the battery and the other information. Further, the control device 11 may be formed to give a signal for stopping the operation of machine body 1 in case it is required so as to prevent an accident during stitching operation.

The machine body is provided with a device 3 which may be operated by the machine operator to change the control content of sewing machine.

According to the embodiment, the control content changing device 3 includes a device 30 for switching the instruction signal from the controller 2 between "effective" and "ineffective" and a device 31 for changing the speed control of sewing machine.

The switching device 30 is operated through operation of an operating device 6 (FIG. 1) by the machine operator to switch the pressing operation of controller 2 between "effective" and "ineffective". Namely in case the switching device 30 is made ineffective, the control device 11 neglects the instruction signal from the controller 2 which is transmitted through the receiver device 10. Therefore, in this case if the machine body 1 receives the machine drive signal, the control device 11 gives a stop signal to a motor drive device 12 which is then operated to maintain a machine motor as stopped.

Therefore with the switching device 30 being selected as is in the ineffective condition, the machine body 1 will not respond to wrong operation of the controller 2. Thus the safety may be secured.

In case the switching device 30 is selected as is in the effective condition, the machine body 1 is responsive to the instruction signal from the controller 2 to perform the normal stitching operation.

Figure 4:
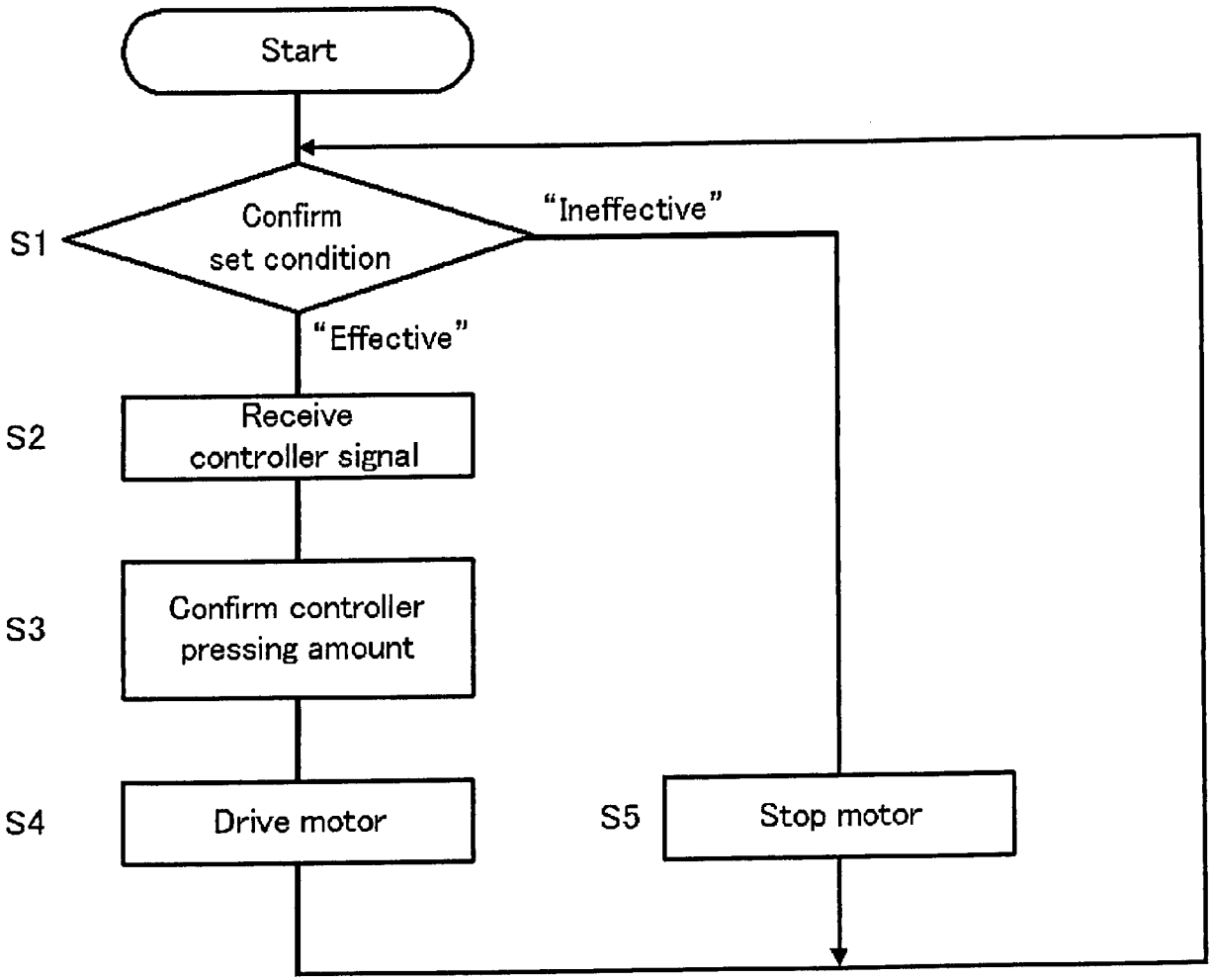
FIG. 4 is a flow chart showing the operation of the invention.

FIG. 4 shows the operation of the control device 11 in case the switching device 30 is switched between the condition in which the instruction signal from the controller 2 is made effective and the condition in which the instruction signal from the controller 2 is made ineffective.

The control device 11 confirms the condition of the switching device 30 (step S1). In case the condition is selected as making effective the instruction signal from the controller 2, the control device 11 receives the instruction signal from the controller 2 through the receiver device 10 (step S2) and confirms the pressing level of the controller 2 which is detected at the transmission device 20 (step S3) and controls the motor drive device 12 in accordance with the pressing level of the controller 2 and drives the machine motor (step S4).

In case the condition is selected in step S1 as making ineffective the instruction signal from the controller 2, the control device 11 neglects the instruction signal from the controller 2 and controls the motor drive device 12 so as to maintain the machine motor as stopped (step S4).

According to the embodiment, the speed control changing device 31 has the following three functions which may be used individually or in combination;

1. Changing the control content so as to start the sewing machine at a low speed in response to the starting instruction at the time of initial press of the controller 2.
2. Changing the control content so as to drive the sewing machine at a drive speed in accordance with the pressing amount of the controller 2 while a maximum drive speed is predetermined.
3. Changing the control content so as to change the rate between the pressing amount of the controller 2 and the drive speed.

Thus the safety during the stitching operation may be obtained by controlling the sewing machine to start at a low speed in response to the first press of the controller 2. In case the sewing machine is operated by outer noises or by wrong operation of the controller 2, the danger may be so reduced as the sewing machine is started at a low speed.

The machine starting speed may be set by the machine operator. Further a curve may be set for regulating the process of drive speed of sewing machine from the low starting speed to the normal stitching speed.

The speed control changing device 31 is so formed as to limit the maximum drive speed of sewing machine. Therefore, if the controller 20 is pressed to a maximum amount, the motor drive device 12 will not drive the machine motor at a speed exceeding a predetermined maximum drive speed which may be optionally set by the machine operator.

With the speed control changing device 31 formed as such, the maximum drive speed may be limited below a predetermined value. A safe stitching operation may be secured. Further if the controller is wrong operated, the drive speed of machine motor will not exceed a predetermined drive speed. Therefore a comparatively safe condition may be maintained.

Further the speed control changing device 31 may be operated to change the relation between the pressing amount of controller 20 and the drive speed. For example, for possible occasion that the first pressing amount may be wrong on the side of the machine operator, the controller 20 may be so formed as to be more or less insensitive in the first pressing and to reduce the increasing speed in response to the increasing pressing amount. A complete insensitive region may be provided where the speed control is not responded.

It is preferable that the relation between the pressing amount of controller 20 and the drive speed may be optionally set by the machine operator in accordance with the stitching object.

According to the embodiment of the invention, as the control content may be variously changed or modified by the control content changing device 3, the safety of the sewing machine may be secured. Especially as the instruction from the controller 20 may be made ineffective by the switching device 30, the outer noises and the wrong operation of controller 20 will give no adverse influence to the machine body 1. Therefore an extremely high safety may be secured to the operation of sewing machine.

Further according to the embodiment of the invention, the control content changing device 3 may be operated by way of operation of the operating device 6 which is made by the machine operator. For example, in case the safety is to be secured when the machine operator leaves the sewing machine with interruption of stitching operation, the operation of controller 20 may be made ineffective by operation of the operating device 6. This is the same as to the change of the speed control contents.

Further the control device 11 is connected to the identifying device 4 for identifying the wireless controller 2 so that the control device 11 may be operated in response only to the signal from the wireless controller 2.

Figure 2:
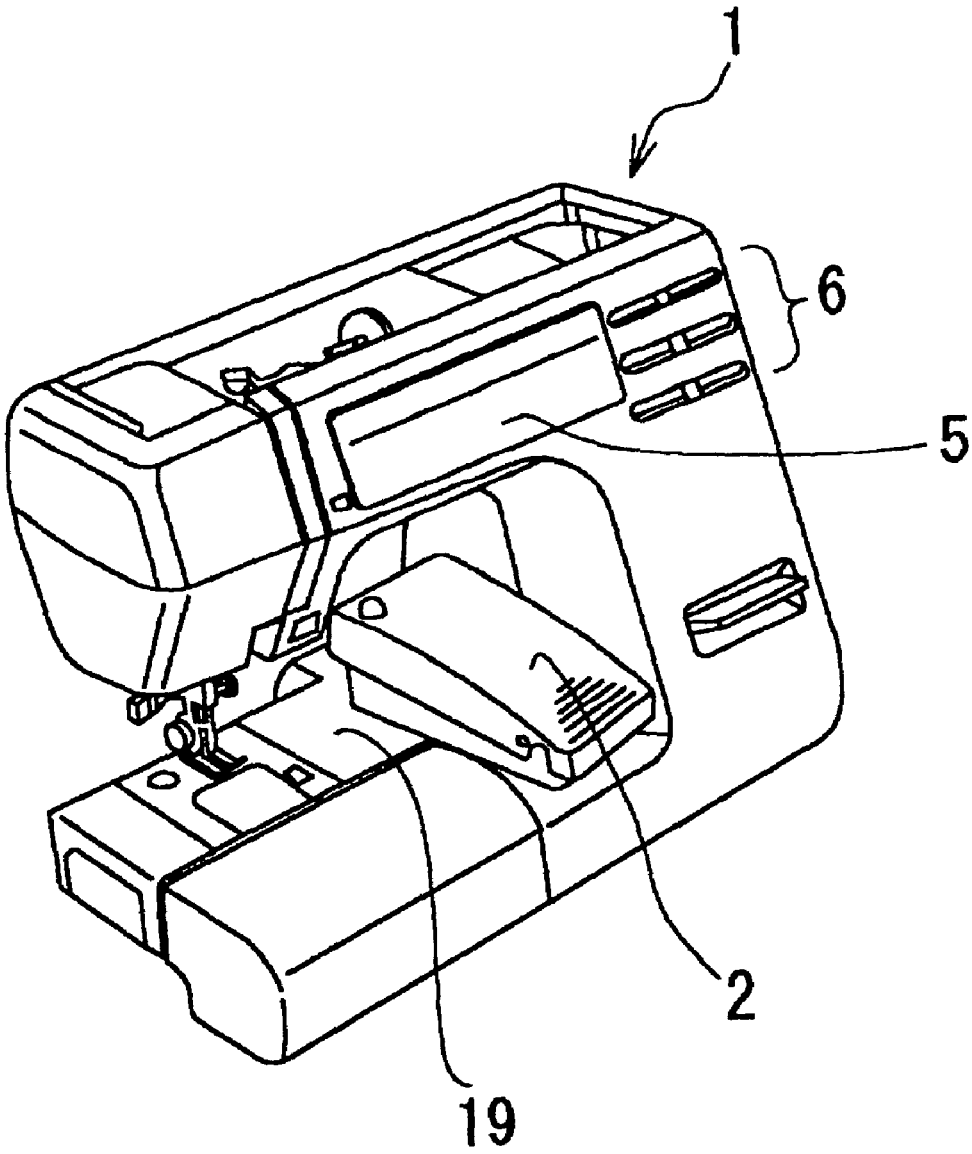
FIG. 2 is a perspective view of the sewing machine having the invention incorporated therein and shown with a wireless controller placed on the sewing machine.

As shown in FIG. 1, the machine body 1 has a machine bed 19 which has connecting terminals 40 provided thereon as are exposed to receive the ID code of the controller 2 and to charge the controller 2. As shown in FIG. 2, the machine bed 19 has an area which is large enough to support the controller 2. The controller 2 has second connecting terminals 41 provided on the bottom surface thereof to cooperate with the connecting terminals 40 provided on the machine bed 19 when the controller 2 is placed on the machine bed 19. With contact between the connecting terminals 40 and the connecting terminals 41, the ID code of the controller 2 is transmitted to the machine body 1.

FIG. 5 shows the transmitting device 20 of the controller 2 and the block diagram which is a part of the block diagram on the side of the machine body 1 including the identifying device 4.

The controller 2 has the variable resistor 26 provided therein as mentioned hereinbefore. The signal produced in response to the pressing amount of the controller 2 is converted into a digital signal at an A/D converter 21 and modulated at a modulator 23 and then transmitted to the machine body 1 through a transmission circuit 24.

The controller 2 has a memory 22 for storing therein the I/D code which is specific to the controller 2. The code signal is transmitted to the machine body 1 through the connecting terminals 40,41 by initializing operation at the operating device 6.

The ID code is transmitted as added to the signal from the A/D converter 21.

The controller 2 is provided with a battery 25 which may be charged to supply power to the controller 2. The battery 25 may be charged from the machine body 1 through the connecting terminals 40,41 which are placed in contact with each other.

The battery 25 may include a storage battery, a secondary battery, an electric double layer capacitor and so on.

The machine body 1 is provided with a charger 17 which is connected to one of the connecting terminals 40 to charge the battery 25 of the controller 2 through one of the connecting terminals 41.

Further the machine body 1 is provided with an input device 15 of the identifying device 4 which is connected to the other of the connecting terminals 40 to receive the ID code from the ID code memory 22 of the controller 2 and to register the ID code into a register device 16.

The receiver device 10 has a receiving circuit 10*a* provided therein for receiving a speed signal which is produced in accordance with the pressing amount of the controller 2. The speed signal is then demodulated at a demodulator 10*b* and is then decoded at a decoder device 16 and is transmitted to the control device 11.

The speed signal is transmitted together with the ID code of controller 2 from the transmitting circuit 24 of controller 2. The ID code is transmitted to the identifying device 4 through the decoder 14. The identifying device 4 includes a checking device 13. The checking device 13 compares the ID code transmitted from the decoder 14 and the ID code registered in the register device 16. In case the compared ID codes are out of accord, the signal indicating the compared effect is transmitted to the control device 11. In response to the signal from the checking device 13, the control device 11 is operated to make the speed signal ineffective.

Figure 6:
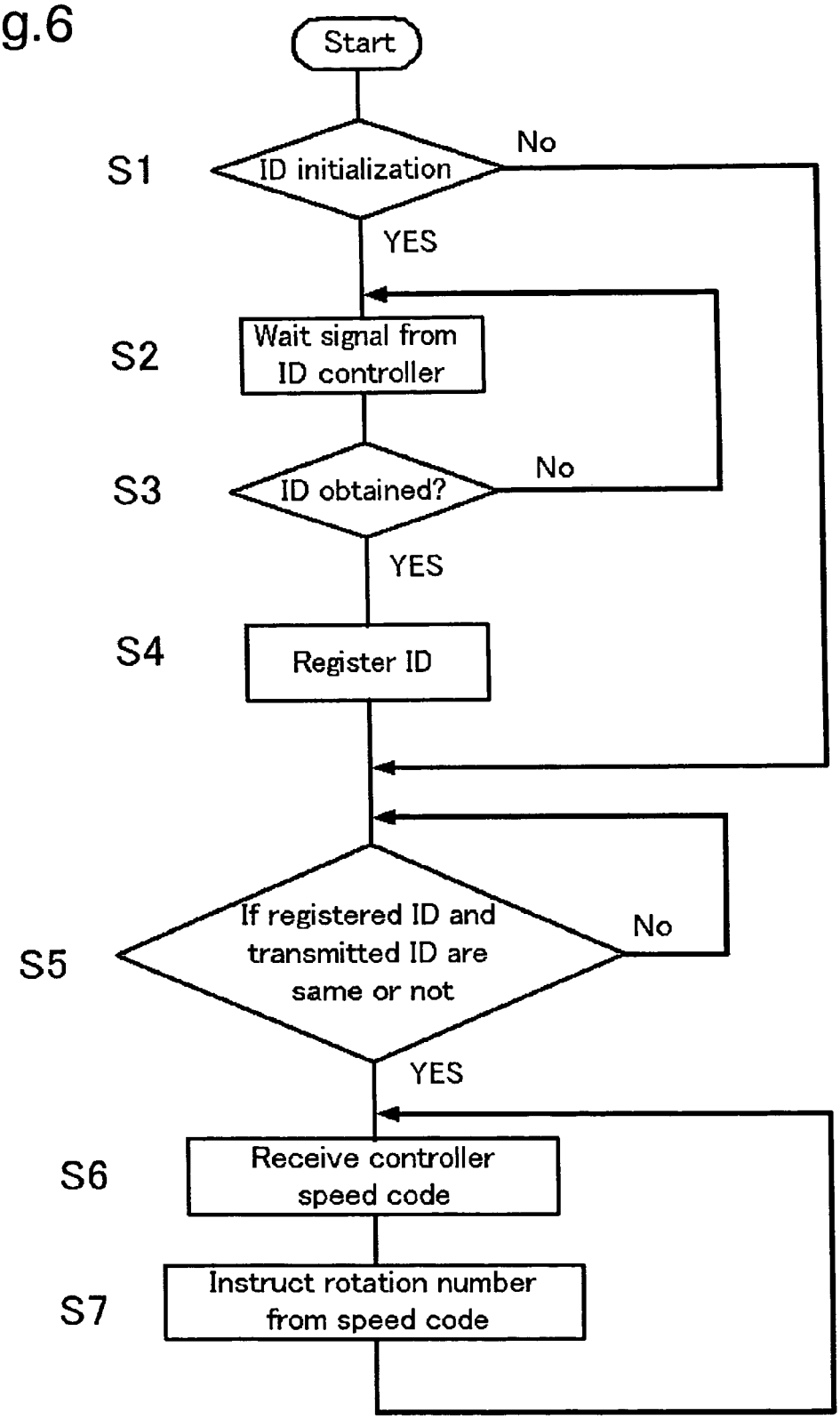
FIG. 6 is a flow chart showing the operation of the invention.

The operation of the embodiment will be described in reference to FIG. 6.

The controller 2 is placed on the machine bed 19 in the manner that the connecting terminals 40 of the machine bed 19 and the second connecting terminals 41 of the controller 2 may be placed in contact with each other, and then the operating device 6 is operated to select the initializing mode of the IC code (step S1). Then the IC code is read out of the IC code memory 22 of the controller 2 (steps S2, S3) and is registered in the register device 16 of the machine body 1 (step S4).

When the decoder 14 receives the ID code from the controller 2, the checking device 13 compares and discriminates if the ID code from the controller 2 and the ID code registered in the register device 16 are in or out of accord (step S5). In case the compared ID codes are found to be out of accord, the operation remains as stopped. In case the ID codes are found to be in accord, the accord signal is transmitted to the control device 11 (step S6). Then the control device 11 controls the machine motor with the speed signal transmitted from the controller 2 (step S7).

In this connection, when the controller 2 is placed on the machine bed 19 and the connecting terminals 40 and 41 are placed in contact with each other, the battery 25 of the controller 2 is charged from the charger 17.

As described hereinbefore, according to the embodiment, the battery 25 may be charged from the charger 17 only by positioning the controller 2 on a predetermined place of the machine bed 19, and the initialization of ID code may be made by operation of the operating device 6. Therefore, the charging operation and the initialization of ID code may be very easily carried out.

Further according to the embodiment, the conditions of controller 2 may be indicated at the indicating device 5. Namely the information including the power remaining amount of battery 25 of controller 2, signal level and so no may be indicated. Further the warning to change the power source may be indicated at the indicating device 5.

The invention thus described, it will be obvious that the same may be varied in many ways. Such variations are not to be regarded as a departure from the spirit and scope of the invention, and all such modifications are intended to be included within the scope of the following claims.

What is claimed is:

1. An electric sewing machine comprising;

a machine body, a wireless controller which may be electrically connected to said machine body wirelessly and producing an instruction signal, a receiver means provided on said machine body and receiving the instruction signal from said wireless controller, a control means provided on said machine body for controlling the operation of said machine body in response to the instruction signal received at said receiver means, a means provided on said machine body for changing, by operation of a machine operator, the control content of said control means for controlling the operation of said machine on the basis of the instruction signal.

2. The electric sewing machine as defined in claim 1, wherein said changing means includes a switching means which is adapted to switch the instruction signal from said wireless controller between being effective and being ineffective.

3. The electric sewing machine as defined in claim 1, wherein said wireless controller produces the instruction signals for starting, stopping the sewing machine and for instructing the drive speed of the sewing machine respectively, and wherein said changing means is adapted to change the control content of said control means such that said machine starting instruction may start the sewing machine at a low speed.

4. The electric sewing machine as defined in claim 1, wherein said wireless controller produces the instruction signals for starting, stopping the sewing machine and for instructing the drive speed of the sewing machine respectively, and wherein said changing means is adapted to change the control content of said control means to set a limit of maximum drive speed to the instruction signal from said wireless controller so as to drive the sewing machine at a drive speed below the limit of maximum drive speed.

5. The electric sewing machine as defined in claim 1, wherein said wireless controller is adapted to produce a drive speed signal in accordance with a pressing amount thereof, and wherein said changing means is adapted to change the rate between the drive instruction signal from said wireless controller and the actual drive speed of sewing machine which is driven by the drive instruction signal.

6. The electric sewing machine as defined in claim 5, wherein said wireless controller is adapted to produce the instruction signals for starting, stopping the sewing machine and for instructing the drive speed of the sewing machine respectively, and wherein said changing means is adapted to change the control content of said control means to reduce the change of drive speed in a predetermined region of pressing amount of said wireless controller at the time of starting the sewing machine.

7. The electric sewing machine as defined in claim 5, wherein said wireless controller is adapted to produce a drive speed signal in accordance with the pressing amount thereof, and wherein said changing means is adapted to change the control content of said control means to reduce the change of drive speed to zero in a predetermined region of pressing amount of said wireless controller at the time of starting the sewing machine.

8. The electric sewing machine as defined in claim 1, further comprising an indicating means provided on said machine body to indicate the condition of said wireless controller.

9. An electric sewing machine comprising;

a machine body, a wireless controller electrically connected to said machine body wirelessly and operated to produce a machine control signal, an output means provided on the side of said wireless controller to produce a signal for identifying said wireless controller, a transmission means provided on the side of said wireless controller to transmit said machine control signal and said wireless controller identifying signal to said machine body, a receiver means provided on the side of said machine body to receive said machine control signal and said wireless controller identifying signal from said wireless controller, an input means provided on the side of said machine body to receive by wire said wireless controller identifying signal from said output means, a register means provided on the side of said machine body to register therein said wireless controller identifying signal which is received by said input means from said output means by wire, a detecting means provided on the side of said machine body to compare said wireless controller identifying signal registered in said register means and said wireless controller identifying signal received from said receiver means, said detecting means neglecting said machine control signal from said wireless controller in case said identifying signal registered in said register means and said wireless controller identifying signal received from said receiver means are out of accord.

10. The electric sewing machine as defined in claim 9, wherein said wireless controller is provided with a power source which may be charged, and said machine body is provided with a charger device for charging said power source, and said input device and said charger device have a set of common connecting terminals so that said wireless controller identifying signal may be received by said input device at said set of common connecting terminals at the time of charging said power source.

11. The electric sewing machine as defined in claim 10, wherein said common connecting terminals is provided on a bed of said machine body and a second connecting terminals is provided on said wireless controller, said second connecting terminals being connected to said power source and said output means and being in contact with said common terminals when said wireless controller is placed on a predetermined area of said machine bed.

12. An electric sewing machine comprising;

a machine body, a wireless controller connected to said machine body wirelessly and producing an instruction signal, a receiver means provided on the side of said machine body to receive the instruction signal from said wireless controller, a control means for controlling the operation of sewing machine on the basis of the instruction signal received by said receiver means, a means for changing the control content of said control means for controlling the operation of sewing machine on the basis of the instruction signal, an output means provided on the side of said wireless controller to produce a signal for identifying said wireless controller, a transmission means provided on the side of said wireless controller to transmit said wireless controller identifying signal to said machine body, a receiver means provided on the side of said machine body to receive said wireless controller identifying signal, an input means provided on the side of said machine body to receive by wire said wireless controller identifying signal from said output means, a register means provided on the side of said machine body to register therein said wireless controller identifying signal which is received by said input means from said output means by wire, a determining means provided on the side of said machine body to compare said wireless controller identifying signal registered in said register means and said wireless controller identifying signal received from said receiver means, said detecting means neglecting said machine control signal from said wireless controller in case said wireless controller identifying signal registered in said register means and said wireless controller identifying signal received from said receiver means are out of accord.

13. The electric sewing machine as defined in claim 12, wherein said wireless controller is provided with a power source which may be charged, and said machine body is provided with a charger device for charging said power source, and said input means and said charger device have a set of common terminals so that said wireless controller identifying signal may be received by said input means at said set of common terminals at the time of charging said power source.

14. The electric sewing machine as defined in claim 13, wherein said common connecting terminals is provided on a bed of said machine body and a second connecting terminals is provided on said wireless controller, said second connecting terminals being connected to said power source and said output means and being in contact with said common terminals when said wireless controller is placed on a predetermined area of said machine bed.

15. The electric sewing machine as defined in claim 12, wherein said changing means includes a switching means which is adapted to switch the instruction signal from said wireless controller between being effective and being ineffective.

16. The electric sewing machine as defined in claim 12, wherein said wireless controller produces the instruction signals for starting, stopping the sewing machine and for instructing the drive speed of the sewing machine respectively, and wherein said changing means is adapted to change the control content of said control means such that said machine starting instruction may start the sewing machine at a low speed.

17. The electric sewing machine as defined in claim 12, wherein said wireless controller produces the instruction signals for starting, stopping the sewing machine and for instructing the drive speed of the sewing machine respectively, and wherein said changing means is adapted to change the control content of said control means to set a limit of maximum drive speed to the instruction signal from said wireless controller so as to drive the sewing machine at a drive speed below said limit of maximum drive speed.

18. The electric sewing machine as defined in claim 12, wherein said wireless controller is adapted to produce a drive speed signal in accordance with a pressing amount thereof, and wherein said changing means is adapted to change the rate between the drive instruction signal from said wireless controller and the actual drive speed of sewing machine which is driven by the drive instruction signal.

* * * * *